United States Patent [19]

Marchetti

[11] 4,422,282

[45] Dec. 27, 1983

[54] MACHINE FOR CLOSING THE UPPER FLAPS OF PARALLELEPIPEDAL CARTONS WITH FOLDABLE FLAPS

[76] Inventor: Augusto Marchetti, Piazza Sicilia 7, 20146 Milano, Italy

[21] Appl. No.: 287,197

[22] Filed: Jul. 27, 1981

[30] Foreign Application Priority Data

Sep. 15, 1980 [IT] Italy ..... 22757/80[U]

[51] Int. Cl.[3] ..... B65B 7/20

[52] U.S. Cl. ..... 53/374; 493/183

[58] Field of Search ..... 493/183; 53/374, 491, 53/137

[56] References Cited

U.S. PATENT DOCUMENTS

| | | | |
|---|---|---|---|
| 3,302,367 | 2/1967 | Talarico | 53/374 X |
| 3,505,774 | 4/1970 | Gidge | 53/374 X |
| 3,775,937 | 12/1973 | Devan et al. | 53/374 X |
| 4,218,862 | 8/1980 | Marchetti | 53/374 |
| 4,262,468 | 4/1981 | Marchetti | 53/374 X |

*Primary Examiner*—James F. Coan

*Attorney, Agent, or Firm*—McAulay, Fields, Fisher, Goldstein & Nissen

[57] ABSTRACT

A closing member for the carton front flap consists of a pair of substantially vertical rods constantly inserted in the path of advancement of said front flap. Another closing member for the carton rear flap consists of a rotatable shovel pivoted on one end of a rigid arm, which can be moved along a stationary guide. The guide is shaped in such a way as to cause a rotary-translatory movement of the arm from a rest position to a working position, in which the shovel engages the carton rear flap from behind. Suitable reacting means cause the shovel to rotate from an inclined rest position to a horizontal working position at the end of said movement of the arm.

8 Claims, 6 Drawing Figures

MACHINE FOR CLOSING THE UPPER FLAPS OF PARALLELEPIPEDAL CARTONS WITH FOLDABLE FLAPS

The present invention relates to a machine for closing the upper flaps of parallelepipedal cartons with foldable flaps.

It is known that for the packing of several products, for example tinned food, there are used parallelepipedal cartons with foldable flaps, which are drawn from a store in flattened condition, placed on a filling bench in upright and widened position with the lower flaps suitably folded in closed position and then filled with the products intended for them.

For the subsequent closure of the upper flaps of the so filled cartons, there are presently used automatic machines in which, along a predetermined path of advancement of the cartons, there are arranged suitable devices capable of closing firstly the end (front and rear) flaps and then the side flaps.

The packing process is finally completed by applying an adhesive sealing tape along the separation splits between the folded upper and lower side flaps.

The presently used closing machines are practically standardized as regards the devices for the closure of the upper side flaps, which devices are substantially constituted by suitably shaped guides, while the solutions employed for the closure of the end flaps are various and often very different.

One of the most efficient solutions is certainly that employed in the machine disclosed in the Italian patent application No. 20372 A /78, filed on Feb. 17, 1978 in the name of the same Applicant, in which the device for closing the upper end flaps comprises a closing member for the front flap and a closing member for the rear flap, which members are carried by respective ends of a common support, shaped as an inverted V, which can be driven to rotate between two working positions to insert alternately said members into the path of advancement of the end flaps and, at the same time, to operate them in the different ways suggested by the different work which they have to carry out.

Object of the present invention is to realize a machine for closing the upper flaps of parallelepipedal cartons with foldable flaps, in which the closure of the end flaps is entrusted to a device, which, while referring under some standpoints to that of the above said prior application, is however constructionally different and simpler and cheaper.

According to the invention, such an object is attained by a machine of the type comprising a support plane for the cartons, advancing means for advancing the cartons along said support plane and, arranged above said support plane along the path of advancement of the cartons, a first closing member capable of engaging the front end flap of the cartons to cause the folding thereof to the closed position and a second closing member capable of engaging the rear end flap of the cartons to cause the folding thereof to the closed position, characterized in that said first closing member consists of a pair of substantially vertical rods constantly inserted in the path of advancement of the front flap of the cartons and said second closing member consists of a rotatable shovel pivoted on one end of a rigid arm displaceable on command along a stationary guide shaped in such a way as to allow said arm to move with rotary-translatory motion from a rest position, which is displaced upward and backward with respect to the sense of advancement of the cartons, to a lowered and advanced working position to engage from behind the rear flap of the cartons, there being provided means adapted to urge by reaction the rotation of said shovel from an inclined rest position to a horizontal working position to fold said rear flap to the closed position during the end part of said movement of the arm.

An embodiment of the machine according to the invention is illustrated for better clarity in the enclosed drawings, in which.

Figure 1:
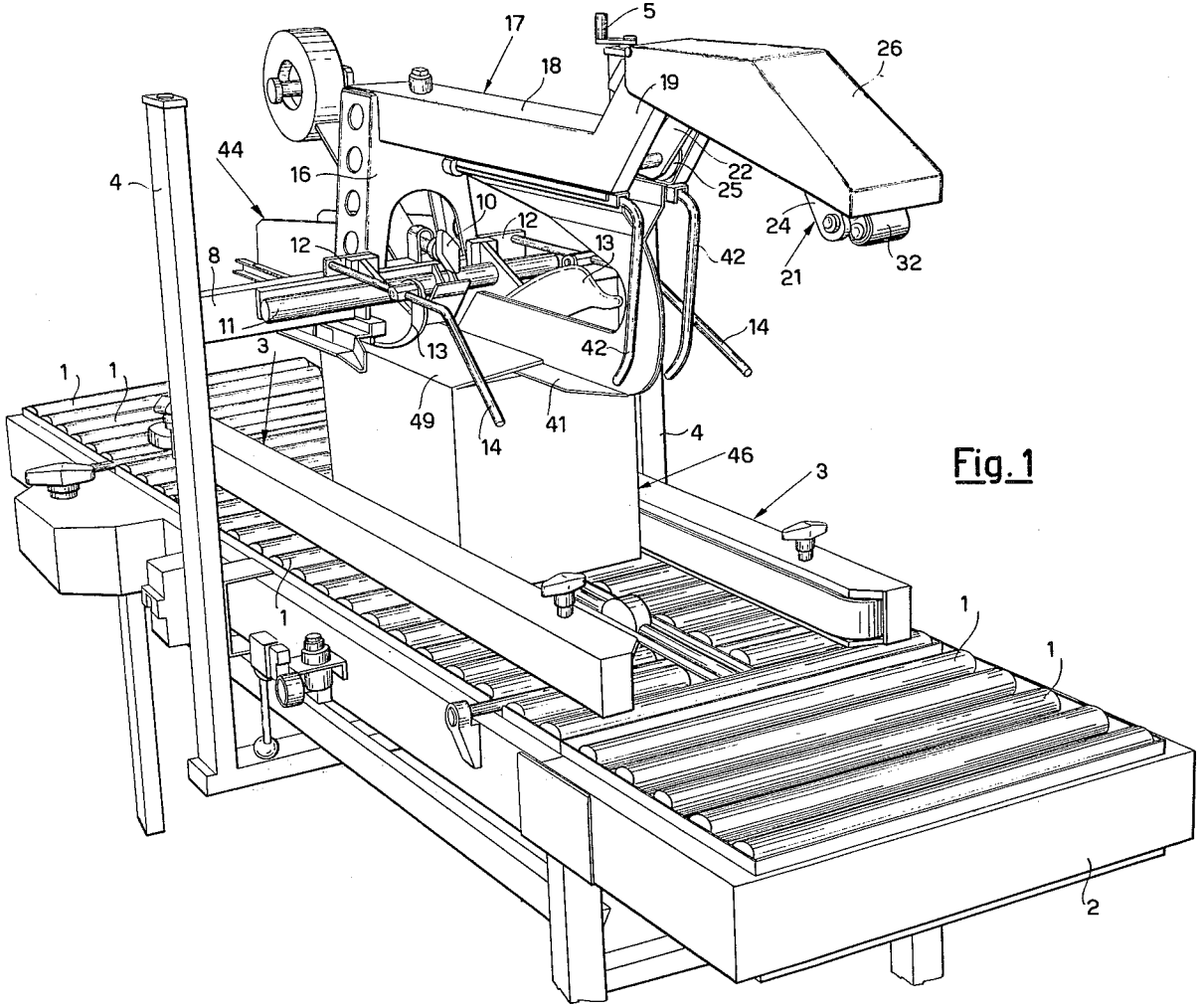
FIG. 1 shows a perspective view of the assembly of the machine.

The machine shown in the drawings, particularly in FIG. 1, comprises first of all a carton support and advancement plane, which is defined by a succession of idle rollers 1 carried by a base frame 2. At the two sides of said support plane there are arranged two belt conveyors 3, which can be placed by known means at an adjustable distance such as to allow their engagement with the carton sides for the continuous advancement of the cartons.

Figure 2:
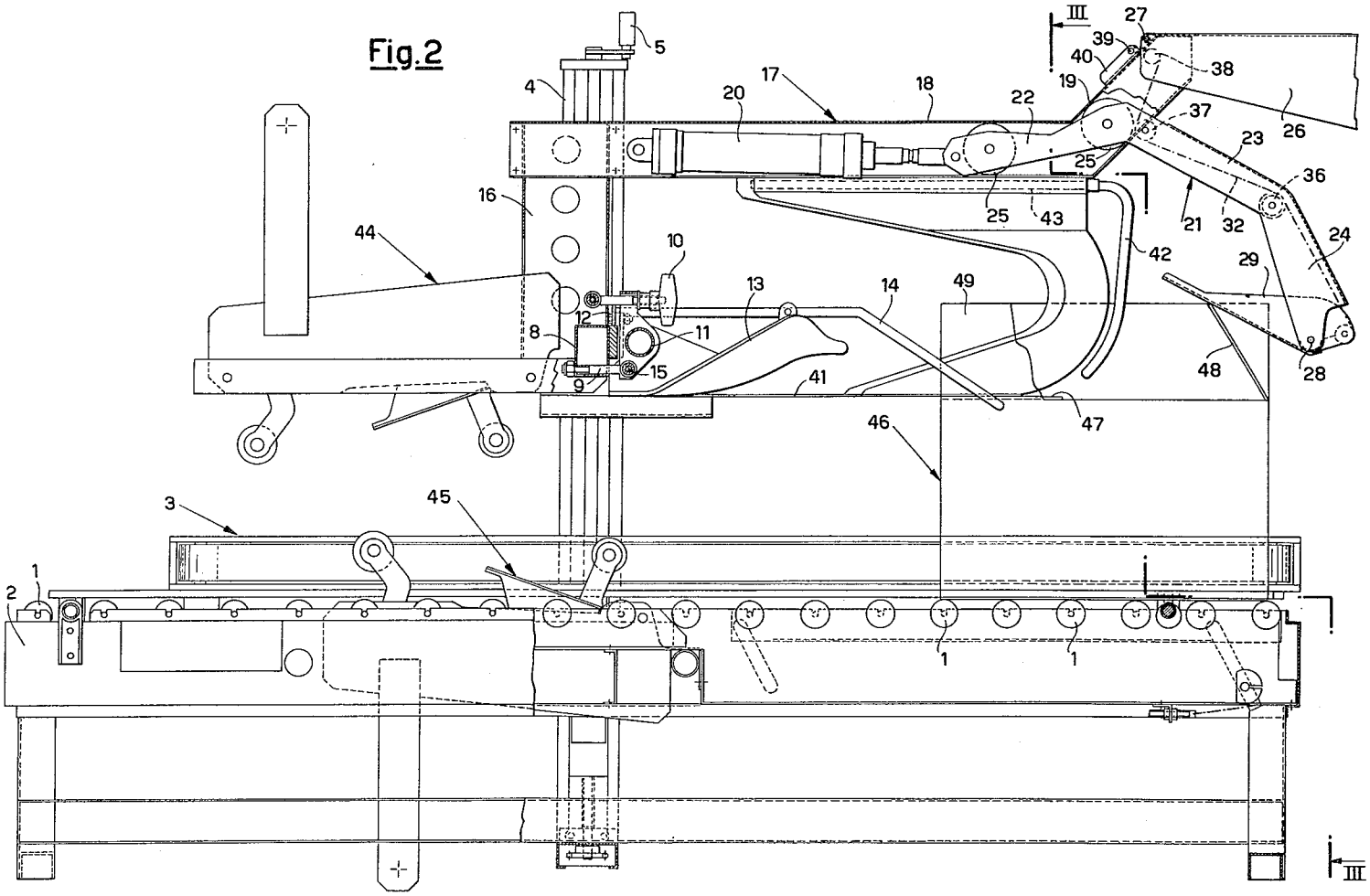
FIG. 2 shows a side view of the machine during the step of closing of the rear flap of a carton.
Figure 3:
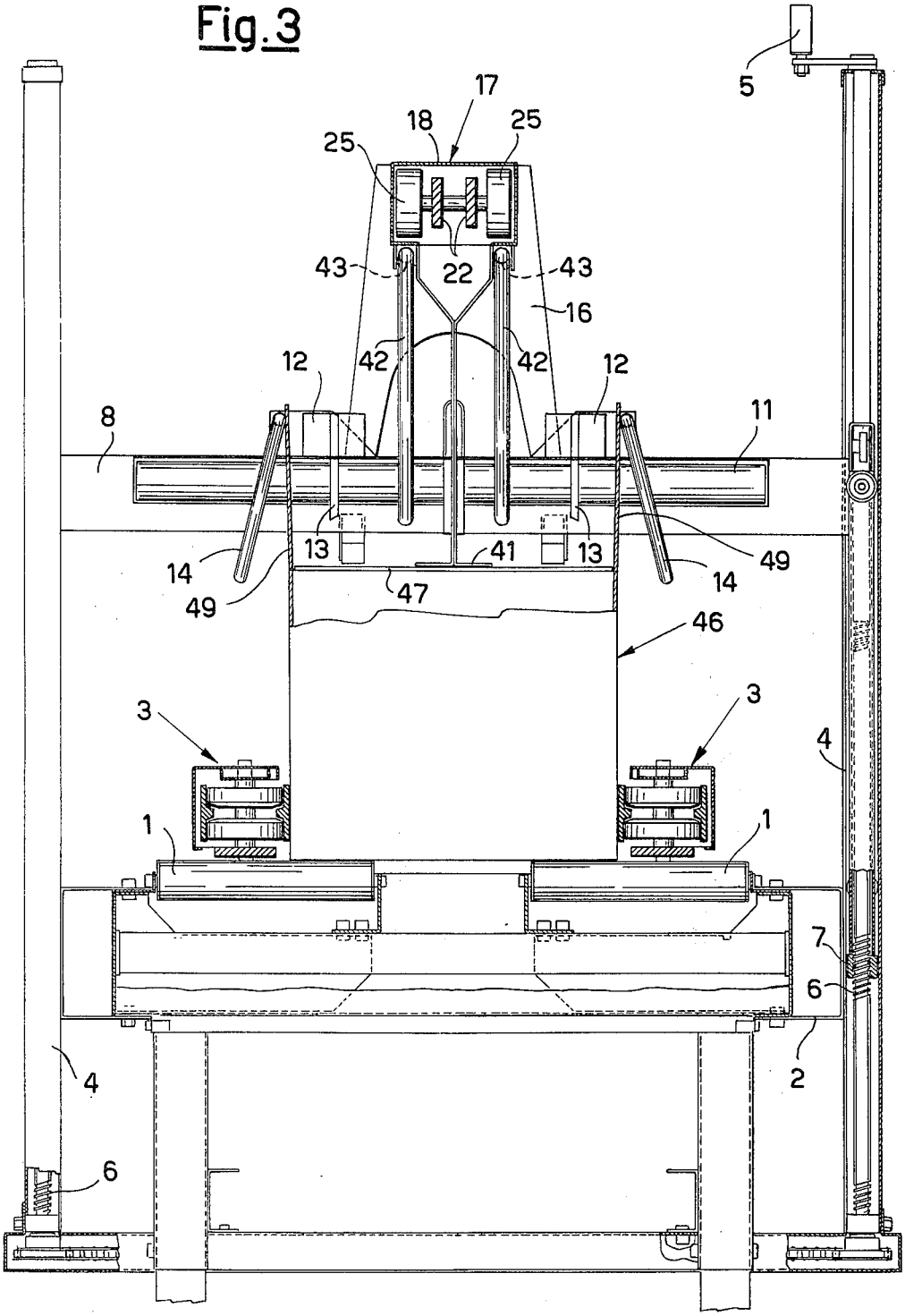
FIG. 3 shows the machine in cross-section along the line III—III of FIG. 2.

Two lateral uprights 4 carry in height adjustable way (by means of a handwheel 5 acting on known means formed by a screw 6 and a nut screw 7 included in the uprights 4, as shown in FIG. 3) a cross bar 8, to which a cylindrical bar 11, on which respective supports 12 for shaped guides 13 for folding the side flaps of the cartons and for adjacent leading rods 14 (FIG. 1 to 3) are slidingly mounted, is fixed in releasable way by means of a lower bolt 9 and an upper clamp 10 (FIGS. 1 and 2). With the clamp 10 firmly tightened, said supports are locked against the cross bar 8, so that the shaped guides 13 and the leading rods 14 are firmly held in position; by loosening the above said clamp, on the contrary, the cylindrical bar 11 may move slightly away from the cross bar 8 by the agency of the hinge 15 formed at the bolt 9 (FIG. 2), so that the supports 12, no longer locked, may be caused to slide along the bar 11 and stopped in the wanted position according to the width of the cartons to be closed.

The cross bar 8 further integrally carries a bridge structure 16, from which a stationary box-like guide 17 including a horizontal section 18 and an upwardly sloping section 19, both open downwards as shown in FIG. 3, extends towards the carton inlet end. In the horizontal section 18 there is housed a pneumatic cylinder 20, which is intended for the movement of a rigid arm 21 formed by three pairs of segments 22, 23 and 24, arranged at angles, the first of which is housed within the box-like guide 17 and can slide in the sloping section 19 and in the end portion of the horizontal section 18 by the agency of two pairs of idle wheels 25 (FIGS. 2 to 6). The other two pairs of segments 23 and 24, on the contrary, are outside the guide 17 and housed inside a protecting cover 26 pivoted at 27 on the end of the stationary guide 17.

Figure 4:
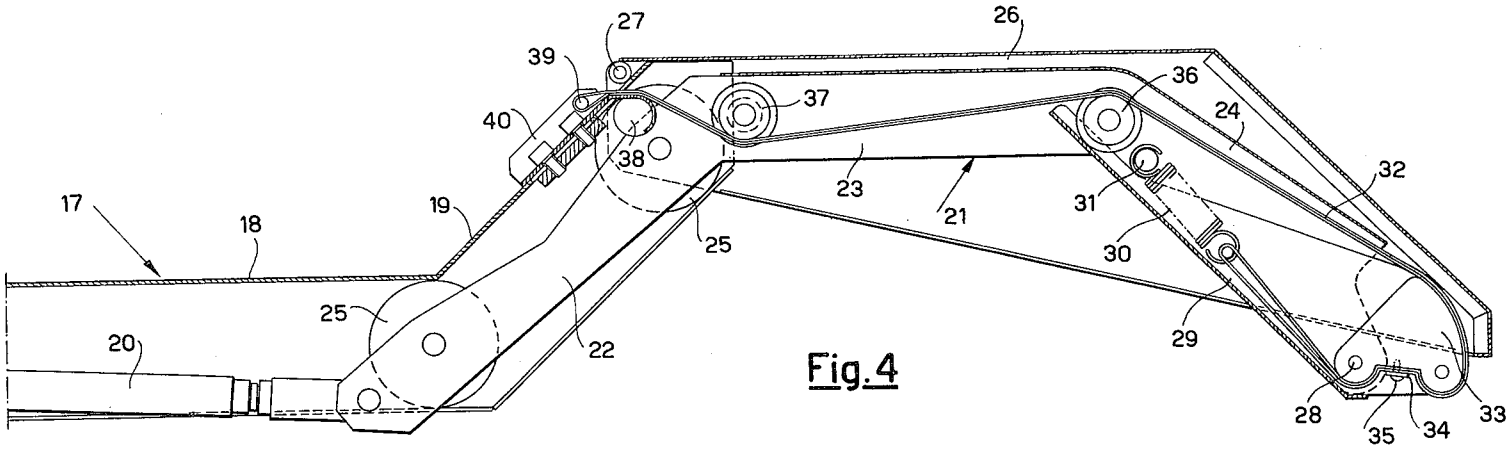
FIG. 4 shows in longitudinal section the rest position of the device for closing the rear flap.
Figure 5:
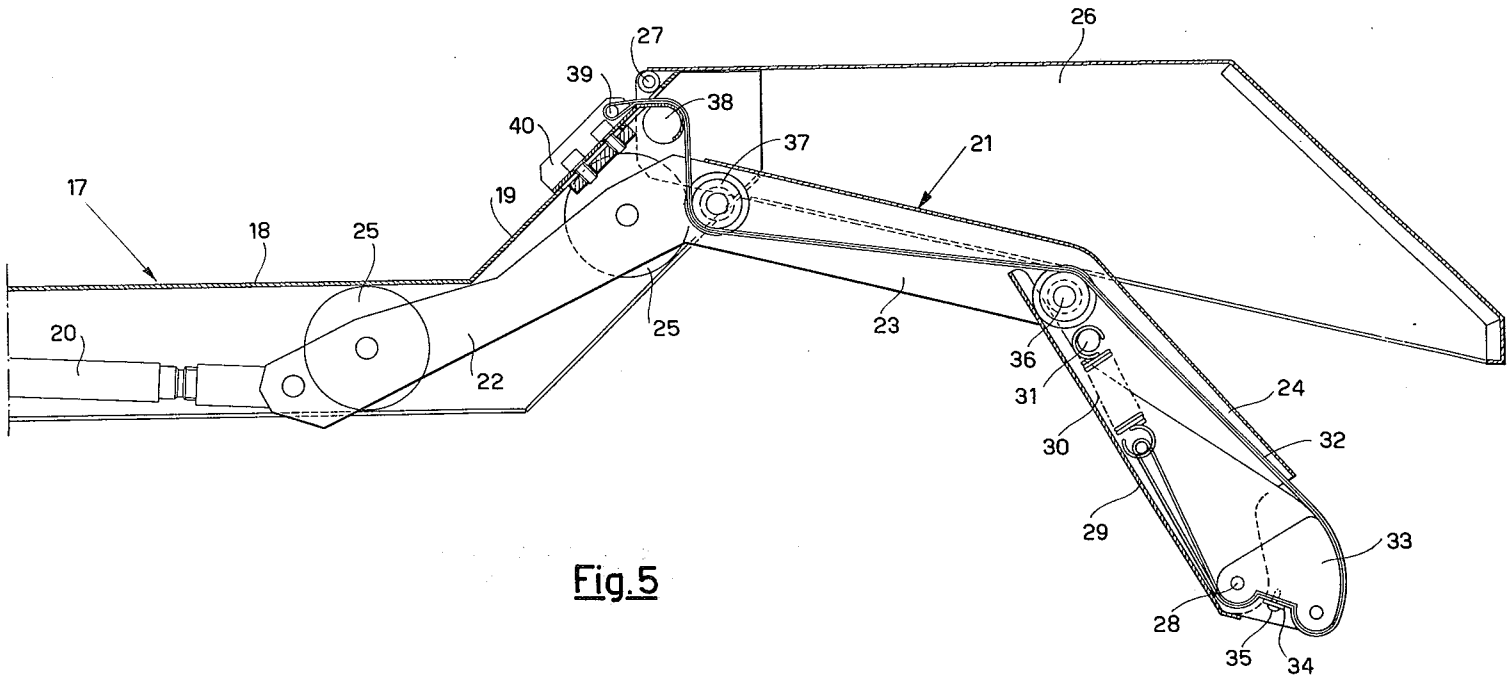
FIG. 5 shows the same device during its movement from said rest position to the working position of FIG. 2.
Figure 6:
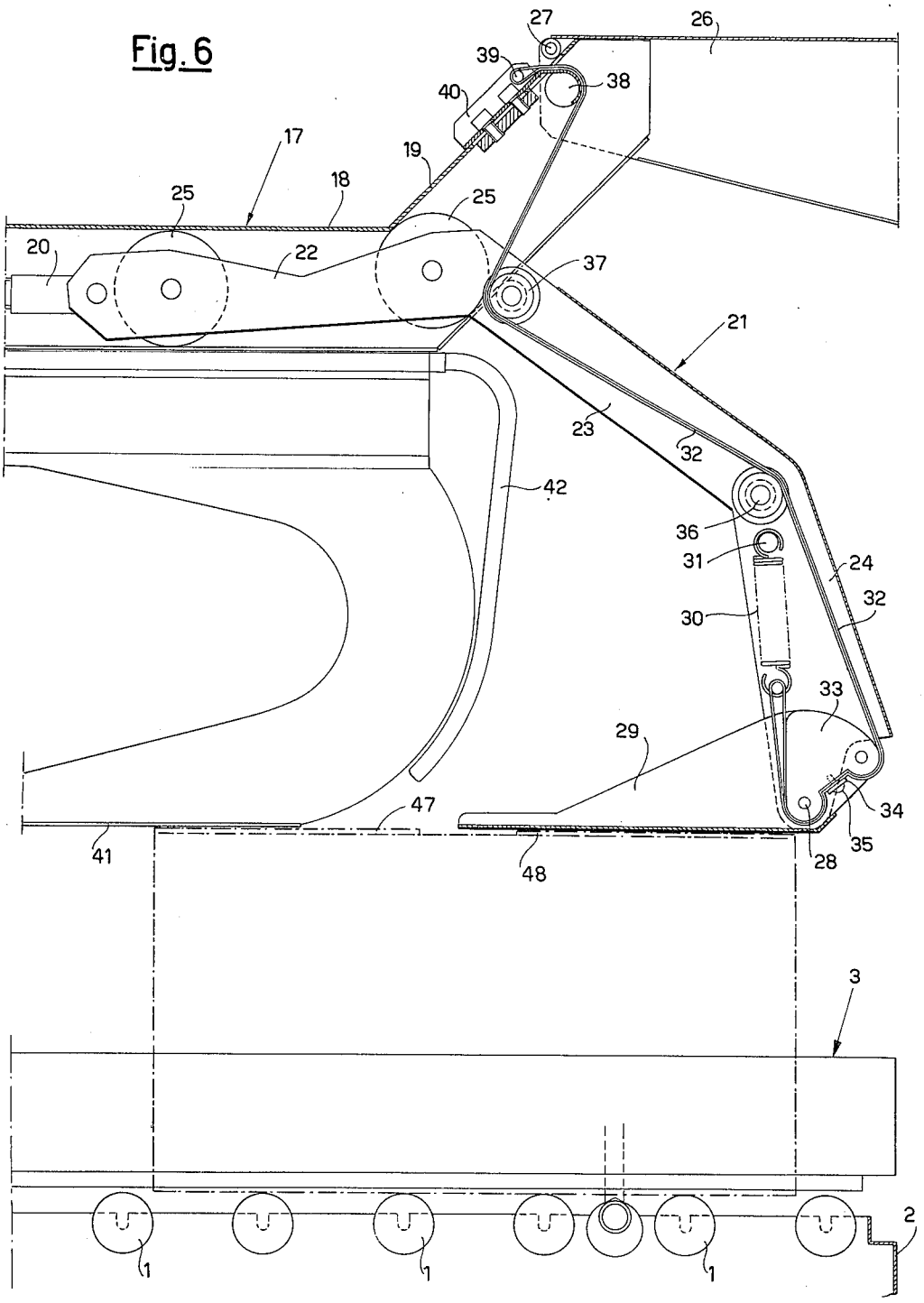
FIG. 6 shows said device at the end of its movement for closing the rear flap.

At the free end of the rigid arm 21 there is hinged at 28 a rotatable shovel 29, which a spring 30 normally keeps in the position illustrated in FIGS. 4 and 5, i.e. upwardly inclined and withdrawn in the outline of the end pair of segments 24 of the arm 21. More precisely, the spring 30 reacts between a post 31 integral with the arm 21 and one end of a double flexible tape 32, which turns around a curved-outline triangular hub 33 integral with the shovel 29, is fixed to said hub by means of a plate 34 and a screw 35 and, having left the hub 33, reaches through a series of idle transmission members 36, 37 and 38 another connection point 39 integral with a support member 40 adjustably fixed to the upwardly sloping section 19 of the stationary guide 17 (FIGS. 4 to 6). The length of the tape 32 is chosen in such a way as to allow the shovel 29 to place itself in the sloping position of FIG. 4, however with the tape being tensioned, when the arm 21 is in turn in the rest position illustrated in the same Figure.

Below the box-like guide 17 there is arranged and made integral a guide 41 with overturned-T cross-secton, which extends parallelly to the carton support plane and has the function of keeping closed the front flap after its folding to the closed position.

The latter operation is carried out by a pair of substantially vertical rods 42 (FIGS. 1 to 3), which is constantly located in the path of advancement of the front flap of the cartons so as to be engaged thereby and, upon collision, to cause the folding of the same flap to the closed position. Said vertical rods are carried by the stationary guide 17 in such a way as to be able to rotate about respective parallel horizontal axes, which are coincident with the axes of horizontal folded portions 43 of the same rods (FIGS. 2 and 3). The two rods 42 can thus be moved to one another by rotation, for the purposes which will be made clear hereinafter.

At the opposite part with respect to the guide 17, the cross member 8 finally carries a device 44 for applying an adhesive sealing tape along the separating split between the upper side flaps, once they have been folded to the closed position. A similar device 45 is inserted in the succession of rollers 1 and has the function of applying a similar adhesive sealing tape along the separating split defined between the lower side flaps of the cartons. Said devices are not described in detail herein, since they are fully known and conventional.

In order to understand the mode of operation of the machine shown in the drawings, let it be assumed that on the support plane defined by the rollers 1, between the two conveyor belts 3, there is placed a parallelepipedal carton 46 provided with a front upper flap 47, a rear upper flap 48 and side upper flaps 49, all of them being in substantially upright position. The conveyor belts 3, by engaging the carton sides, cause the advancement of the carton from right to left (looking at FIG. 2) for the execution of the operations of closing of the upper flaps and of sealing of the upper and lower flaps.

The first action is that of the two vertical rods 42, which, by colliding with the front flap 47, cause the folding thereof to the closed position. This being occurred, the folded flap is taken below the horizontal guide 41, which keeps it in that position after the disengagement thereof from the folding rods 42.

A suitable automatic device (for example a sensor responsive to the attainment of a prefixed position by the carton bottom) subsequently controls the shortening of the pneumatic cylinder 20 with respect to the rest position of FIG. 4, the result being that the pair of segments 22 of the rigid arm 21 is obliged to move back towards the horizontal portion 18 of the guide 17, thus causing a combined motion of descent, advancement and clockwise rotation of the arm 21 (FIG. 5).

Being anchored to a fixed point (39) but also engaged with transmission members (36, 37) which move with the arm 21 away from the above said fixed point, the flexible tape 32 is consequently tensioned and, overcoming the contrary force of the spring 30, causes the rotary-translatory motion of the arm 21 to be accompanied at its final part by an anticlockwise rotation of the shovel 29 about the pivot 28. As can be detected from FIGS. 2 and 6, it is just the shovel 29 which, by moving from behind the rear flap 48 (this feature being attainable by properly positioning the above said sensor), progressively pushes the same flap towards the desired closed position (FIG. 6).

It is to be noted that at this step the two vertical rods 42 do not interfere with the movement of the arm 21 and the shovel 29, since said rods are sufficiently advanced and raised to avoid them to be reached by the front end of the shovel (FIG. 6).

Going out of below the shovel 29, the rear flap 48 is immediately engaged by the guide 41, which keeps it in closed position. At the same time, the side flaps 49 also engage the members intended for their closure, i.e. the shaped guides 13. The side flaps 49 are thus folded towards one another, thereby completing the closure of the carton.

It is important to note that, for a successful result of the latter operation in connection with cartons of whichever length, the possibility of mutual movement which is given the rods 42 by their pivotal connection at the horizontal extension 43 becomes quite important. In case of very long cartons, in fact, when the front ends of the side flaps 49 are engaged by the shaped guides 13, starting the folding of the same flaps, the vertical rods 42 allow themselves to be pushed towards one another by rearer portions of the side flaps, the result being that no obstacle is placed to the folding of the flaps and possible twistings of the same flaps are avoided.

With the flaps being closed, the carton then enters the space between the two sealing devices 44 and 45, going out thereof with two adhesive tapes applied along the two separating splits between the upper and lower side flaps.

Meanwhile, the rigid arm 21 and the shovel 29 have obviously been returned to the rest position (FIG. 4) by lengthening again the cylinder 20, once more under automatic control, for example by means of a sensor placed along the succession of rollers 1. On the occasion of such a return of the arm 21, the pivotal connection between the cover 26 and the stationary guide 17 constitutes a safety against possible accidents caused by the introduction of a hand of the operator between the arm 21 and the cover 26.

As it will certainly have been noticed, the machine illustrated in the drawings, as well as substantially that according to the invention, uses for the folding of the end flaps very simple and, therefore, unexpensive means, which are however extremely practical. In fact, the two vertical rods 42 ensure the perfect folding of the front flap, which receives the folding thrust at two simmetrical vertical zones thereof and, therefore, is not subjected to "warpings", otherwise possible to case of single central thrust. Moreover, it has already been discussed about their possible movement towards one another, which makes easier the folding of the side flaps of very long cartons. As regards the folding of the rear flap, the rotary-translatory motion of the arm 21 and the final rotation of the shovel 29 allow an action from behind, which ensures the perfect execution of the operation, as clearly evidenced in FIGS. 2 and 6. Finally, as already said, there exist the due guarantees against accidents caused by the only moving member, i.e. by the rigid arm 21.

I claim:

1. A machine for closing the upper flaps of parallelpipedal cartons with foldable flaps, the machine comprising:

a support plane for the cartons;

advancing means for advancing the cartons along said support plane and arranged thereabove along the path of advancement of the cartons;

a first closing member capable of engaging the front end flap of the cartons to cause the folding thereof to a closed position;

said first closing member consisting of a pair of substantially vertical rods constantly inserted in the path of advancement of the front flap of the cartons;

a second closing member capable of engaging the rear end flap of the cartons to cause the folding thereof to the closed position;

said second closing member consisting of a rotable shovel pivoted on one end of a rigid arm displaceable on command along a stationary guide having a box-like shape, said guide having a first horizontal section and a second upwardly sloping section, said rigid arm being formed by a succession of segments arranged at angles, the segment most distant from the connection end of said shovel being slidingly housed in said guide and being kept restingly in said upwardly sloping section of said guide, said rigid arm being capable of rotary-translatory movement from said rest position which is displaced upward and backward with respect to the sense of advancement of the cartons to a lowered and advanced working position to engage from behind the rear flap of the cartons;

control means for causing said most distant segment of the rigid arm to slide towards and inside said horizontal section of said guide; and urging means adapted to urge, by reaction, the rotation of said shovel from said rest position to said horizontal working position to fold said rear flap to the closed position during the end part of said movement of the arm.

2. Machine according to claim 1, characterized in that said urging means consist of a fixed-length tape reacting between a fixed point of said guide and a fixed point of said shovel through transmission members fixed to said rigid arm.

3. A machine according to claim 2 wherein said rigid arm, except for said most distant segment, is kept restingly inside a box-like cover pivoted on said stationary guide so as to be freely liftable with respect thereto.

4. Machine according to claim 1, characterized in that said rigid arm, except for said most distant segment, is housed, at rest, inside a box-like cover pivoted on said stationary guide in such a way as to be freely liftable with respect thereto.

5. A machine according to claim 4 wherein said substantially vertical rods are freely rotatable about parallel horizontal axes passing through their upper ends, said horizontal axes being longitudinally oriented relative to the direction of carton advancement.

6. A machine according to claim 4 wherein said urging means consist of a fixed length tape reacting between a fixed point of said guide and a fixed point of said shovel through transmission members fixed to said rigid arm.

7. A machine according to claim 6, wherein said substantially vertical rods are freely rotatable about parallel horizontal axes passing through their upper ends, said horizontal axes being longitudinally oriented relative to the direction of carton advancement.

8. A machine according to claim 7, wherein said rigid arm, except for said most distant segment, is kept restingly inside a box-like cover pivoted on said stationary guide so as to be freely liftable with respect thereto.

* * * * *